US006711772B2

(12) United States Patent
Grassi

(10) Patent No.: US 6,711,772 B2
(45) Date of Patent: Mar. 30, 2004

(54) SURVIVAL TOOL

(76) Inventor: Al Grassi, 435 3rd Ave. #315, Fairbanks, AK (US) 99518

( * ) Notice: Subject to any disclaimer, the term of this patent is extended or adjusted under 35 U.S.C. 154(b) by 408 days.

(21) Appl. No.: 09/797,301

(22) Filed: Feb. 28, 2001

(65) Prior Publication Data

US 2002/0116768 A1 Aug. 29, 2002

(51) Int. Cl.[7] ..... B25F 1/00
(52) U.S. Cl. ..... 7/158; 135/66; 135/80; 43/6
(58) Field of Search ..... 7/158, 170; 43/6; 124/69, 80; 135/66, 910, 77, 78, 80, 81

(56) References Cited

U.S. PATENT DOCUMENTS 253,011 A * 1/1882 Crowley ..... 135/66
1,509,157 A * 9/1924 Leano ..... 135/66
3,387,698 A * 6/1968 Hendricks ..... 206/573
4,351,348 A * 9/1982 Axton ..... 135/66
4,407,318 A * 10/1983 Stuever ..... 135/66

* cited by examiner

*Primary Examiner*—D. S. Meislin
(74) *Attorney, Agent, or Firm*—Michael J. Tavella

(57) ABSTRACT

The present invention discloses a survival tool that can be used as a spear, a crutch, a walking stick, or in pairs as a stretcher. The present invention discloses an elongated rod like device being segmented with each segment having a specific purpose or use. Segments are provided to serve as a spear, a flare, a strobe light, and, for other purposes.

14 Claims, 7 Drawing Sheets

SURVIVAL TOOL

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

The present invention relates generally to the field of survival tools, more particularly, to a combination survival tool/walking stick that can be used as a spear, a crutch, a walking stick, or, in pairs as a stretcher.

2. Description of the Prior Art

Survival tools have been described in the prior art. Additionally, spears, crutches, stretchers, and walking sticks have been described in the prior art. However, none of the prior art discloses the unique combination of features of the present invention. Although the prior art survival devices may have been suitable for the purposes for which they were designed, they would not be as suitable for the purposes of the present invention, as hereinafter described.

BRIEF DESCRIPTION OF THE INVENTION

The present invention discloses a survival tool, which can be used as a spear, a crutch, a walking stick, or in pairs as a stretcher. The present invention discloses an elongated rod like device being segmented with each segment having a specific purpose or use. Segments are provided to serve as a spear, a flare, a strobe light, and, for other purposes.

An object of the present invention is to provide a combination survival tool, which can serve as a spear, a crutch, a walking stick, or in pairs as a stretcher. An object of the present invention is to provide a combination tool, which can be used by an outdoorsman for multiple purposes.

An object of the present invention is to provide a tool, which will make hiking and general outdoorsmanship safer.

The foregoing and other objects and advantages of the present invention will appear from the description to follow.

DETAILED DESCRIPTION OF THE INVENTION

Turning now to the drawings, FIGS. 1 through 12 illustrate the present invention being a survival tool.

Figure 1:
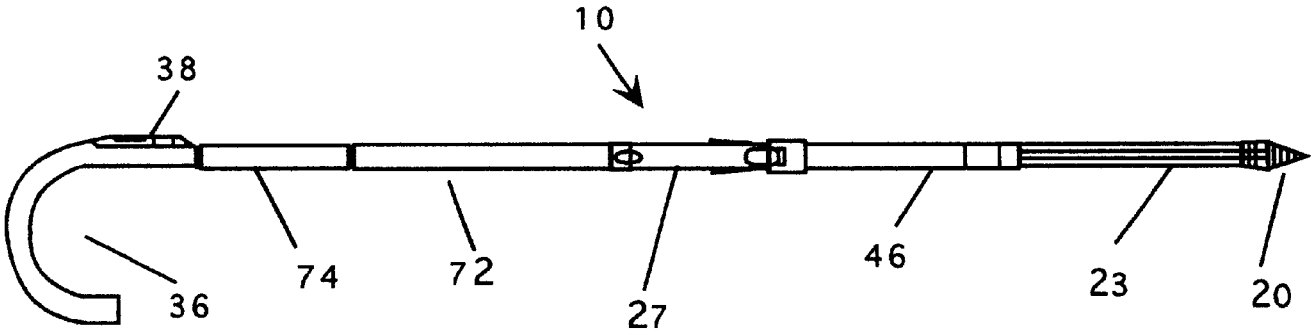
FIG. 1 is a side detail view of an assembled walking stick.

FIG. 1 shows the completely assembled walking stick embodiment of the present invention showing member 10 on its end along with casing 23, flare section 46, strobe light section 27 and crutch end 36.

Figure 2:
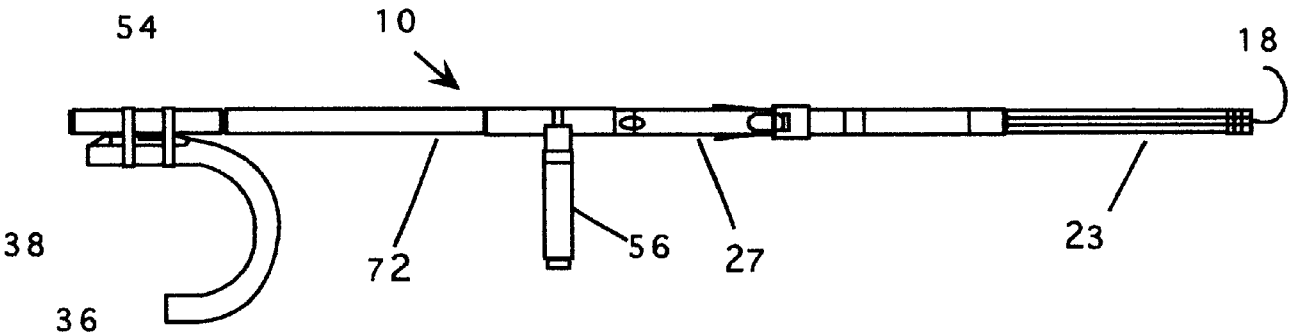
FIG. 2 is a side detail view of the assembled crutch section.

FIG. 2 shows the completely assembled crutch embodiment of the present invention 10. Shown is the casing 23 with end member 18 in place, the handle 56, the crutch end 36, flared area 38 and apertures 54.

Figure 3:
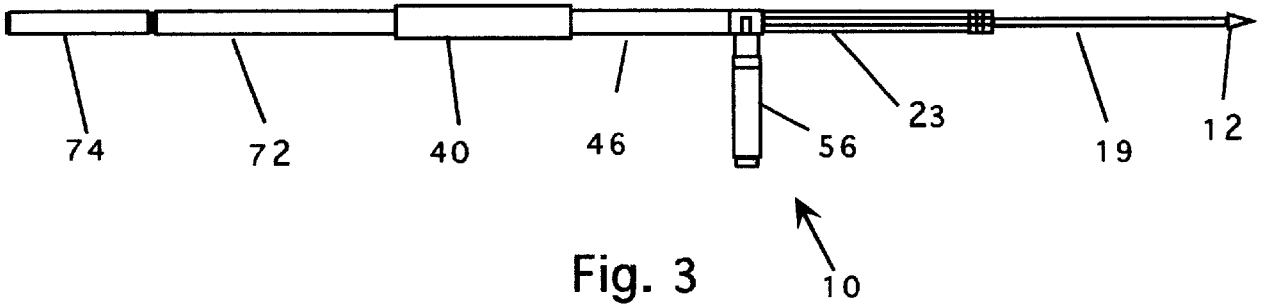
FIG. 3 is a side view of the assembled spear tool.

FIG. 3 shows the completed spear assembly of the present invention 10, the spearhead 12, the spear driver 19, the casing 23, the flare section 46, and the handle 56.

Figure 4:
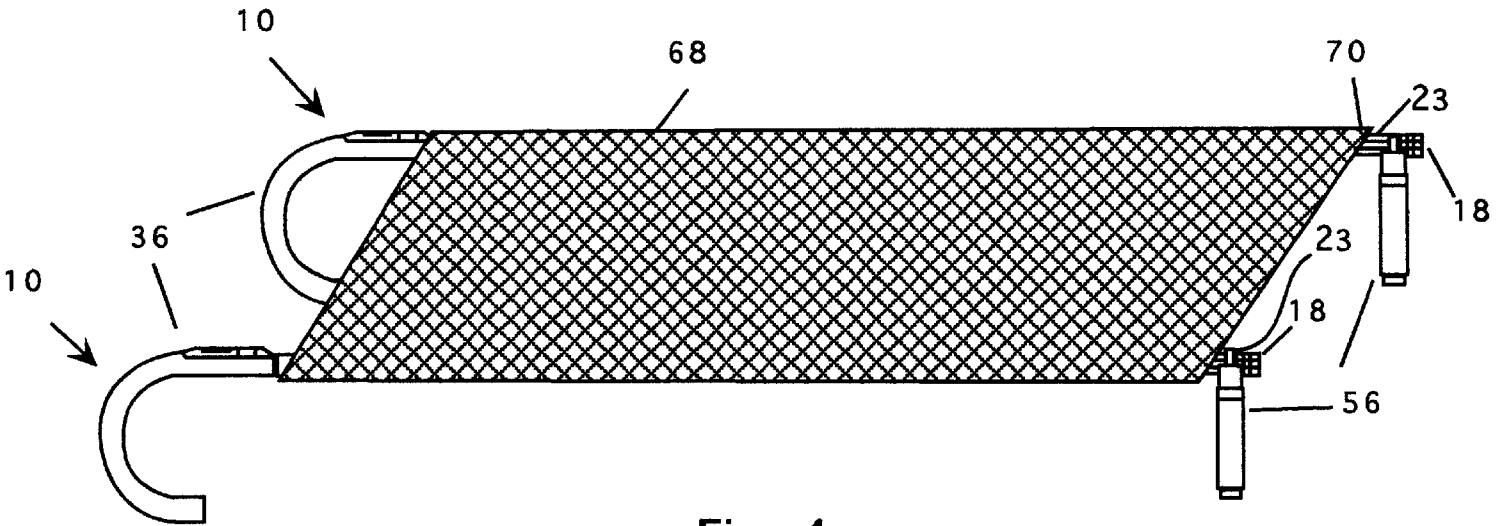
FIG. 4 is a perspective detail view of an assembled stretcher.

FIG. 4 shows the completely assembled stretcher embodiment of the present invention, which uses a pair of shaft members to carry an injured person or to carry game out of the woods. The figure shows the casing 23 with end member 18, handle 56, crutch end 36, canvas or like material 68 forming the bed of the stretcher having a bore or aperture 70 located on each side or edge of the bed 68 through which the shafts of the present invention pass in the standard manner by one skilled in the art. Blankets or shirts could be used as the bed 68.

In FIGS. 1–4, additional sections 72–74 can be attached to the present invention in the standard manner to adjust the length of the present invention to the height of the user. The entire unit is designed to be dissembled and to fit in a small backpack having loops for retaining each section.

Figure 5:
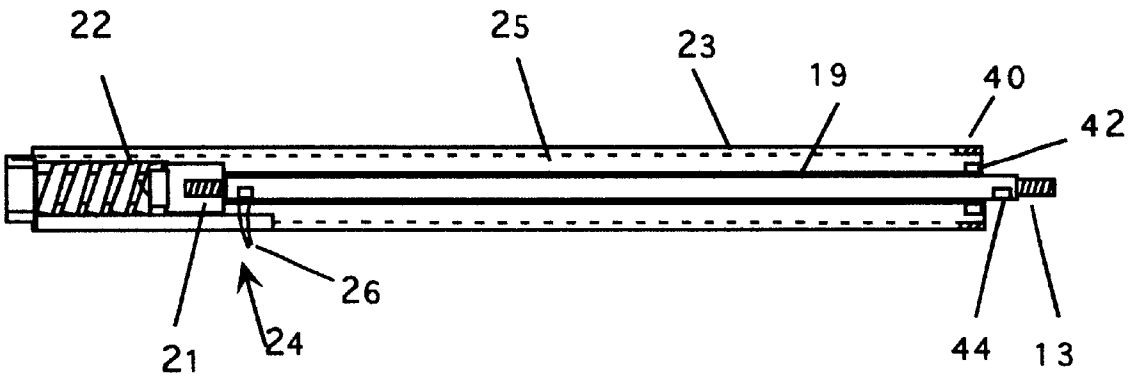
FIG. 5 is a detail cross-sectional view of the triggered spear casing section.

FIG. 5 shows an approximately 18.5 inch long section being a casing or cylinder 23 in which the spear driver 19 is inserted which allows spear driver 19 to slidingly operate in its bore 25 which houses the piston 21, spring 22 and trigger assembly 24. The trigger 26 is a folding trigger in order to keep the stick streamlined when in use as a walking stick. The trigger has a hole (not shown) drilled in its rear so that the user could tie a string therein and use the handle section 56 as to be able to move back three or four feet on the stick and be able to capture snakes while remaining at a safe distance from them so as to safely obtain food. Note that the cylinder 23 has external threads 40 located on its end along with a spacer 42 having an aperture 44 therein through which spear 19 driver passes. The spring assembly 22 is constructed and functions in the standard manner so as to propel the spear driver 19 forward when the trigger 26 is pulled by the finger of the user.

Figure 6:
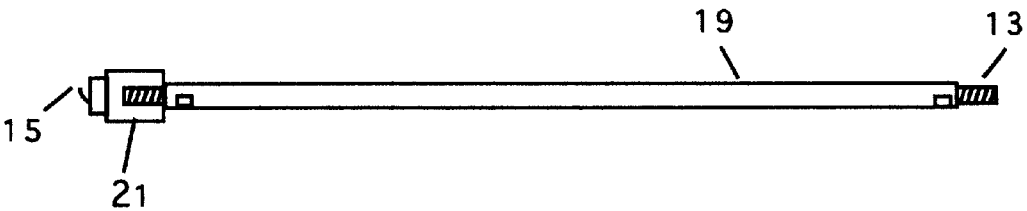
FIG. 6 is a side view of the spear driver section with piston.

FIG. 6 shows spear driver 19 which is a cylindrical rod having a treaded male member 13 on one distal end and spring attachment or engagement means 15 that is located on the end of the piston 21. The spear driver 19 is used as a spear-fishing device using the attachments shown in FIG. 13 and 14. The member 16 (FIG. 15) is always incorporated because it contains a safety pin 17 to prevent accidental firing and also provides means for connection for each of the tips 18 and 20. When not in use, the spear tip is removed and stored in a convenient location. Note that member 16 is internally threaded and members 18 and 20 are externally threaded, so that a stud adapter (see FIGS. 18 and 19) can incorporated and be screwed onto the end of the spear driver to use members 18 and 20.

The spear driver 19 of FIG. 6 can be made of metal. The piston 21 and spring 22 are also made of metal. The remainder of the stick can be made of extruded plastic. The threads of each section have to be coarse to prevent the stick from coming apart when being used as a walking stick. The placement of a small rubber washer at the bottom of each female end could possibly achieve the same purpose.

Figure 7:
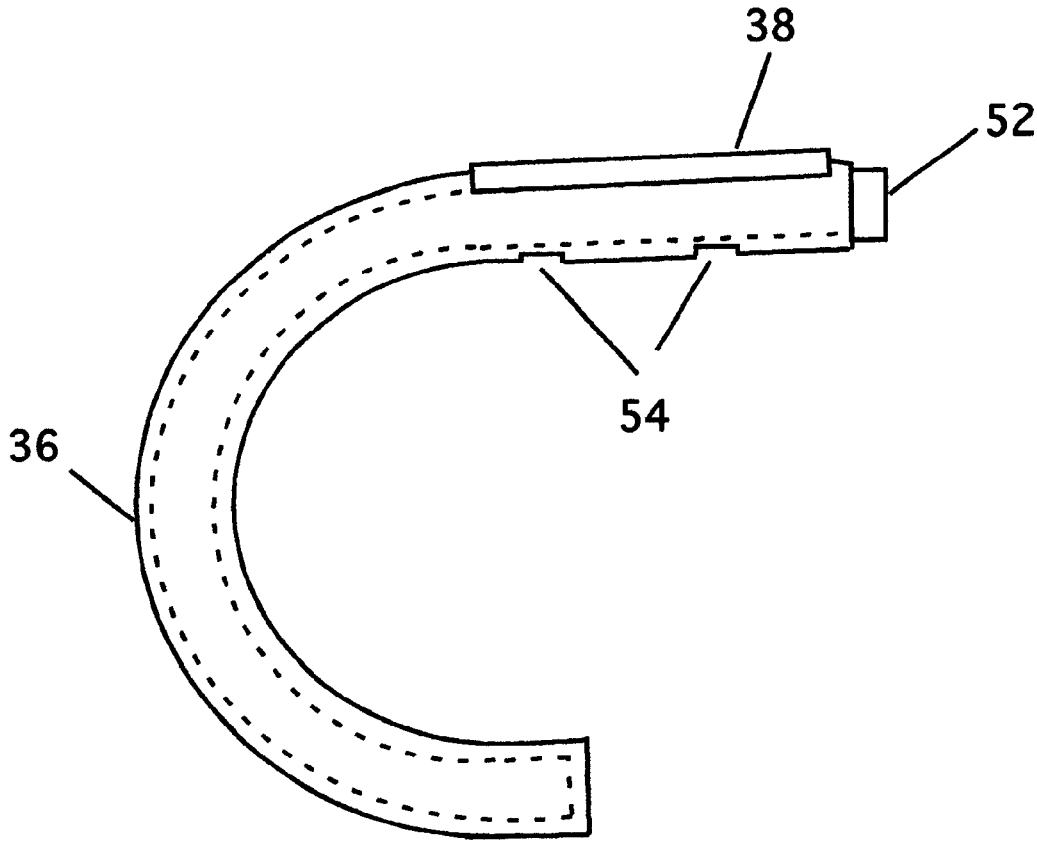
FIG. 7 is a side view of a cane or crutch end section.
Figure 8:
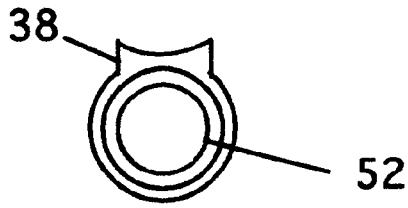
FIG. 8 is a front detail view of the cane or crutch end section.

FIGS. 7 and 8 show the crutch end 36 with attachment means 52 to the present invention. FIG. 8 shows an end view of the handle showing a flared area 38 which encompasses about 25 percent of the circumference of the stick in order to make clamping easier. A pair of apertures 54 pass through the crutch and flared area 38 through which fastener means (not shown) such as nuts and bolts could pass with which to fasten the crutch ends to the shaft of the present invention. The crutch ends 36 are designed to cradle and fit underneath the shoulders of a user. A sticky substance could be placed on the surface of the flared area 38 to make attachment to the shaft easier while the fastening means was being connected.

Figure 9A:
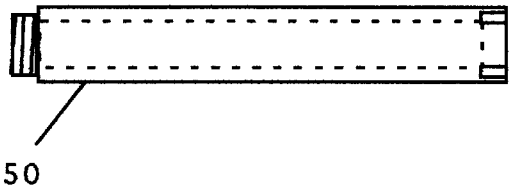
FIG. 9A is a side detail view of a 30-minute flare section.
Figure 9B:
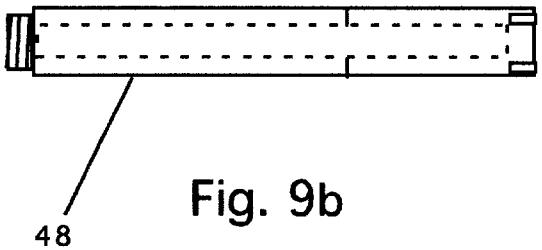
FIG. 9B is a side detail view of a two aerial flare section.
Figure 9C:
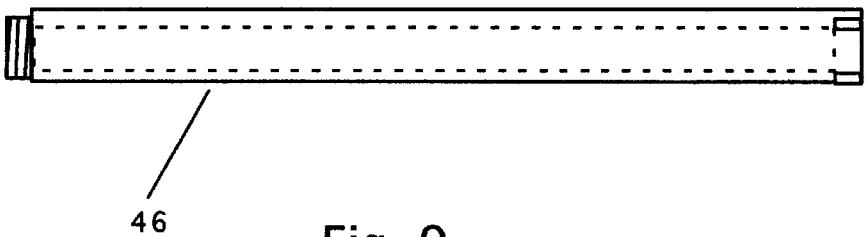
FIG. 9C is a side detail view of a 15-minute flare section.

FIGS. 9A–9C, show alternative devices to be used as a flare for incorporation into the present invention. FIG. 9*c* shows a 30-minute flare 46. FIG. 9*b* shows two aerial flares 48. FIG. 9*a* shows a single 15-minute flare 50. These flares are used primarily for signaling but the 30 minute flare 46 can also be used to dry firewood in the event that were necessary. The aerial flares 48 are two skyblazer flares that can be shot up to 500 feet into the air.

Figure 10:
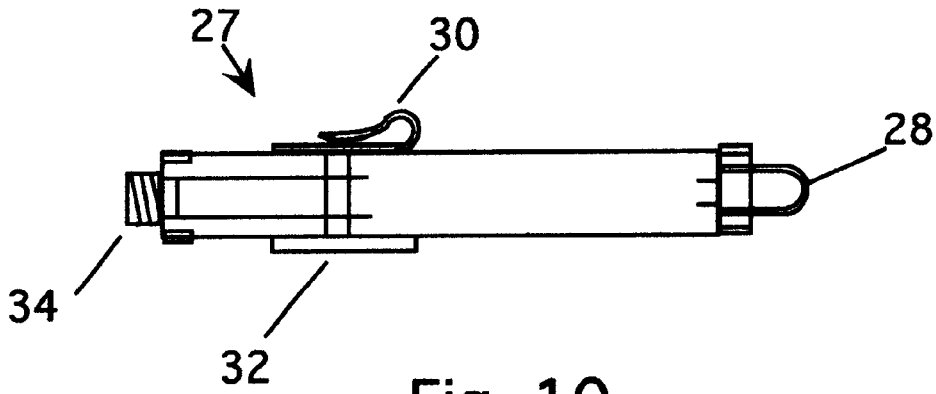
FIG. 10 is a side detail view of a strobe light section.

FIG. 10 shows a powerful strobe light section 27 for signaling for help that incorporate the international S. O. S. signal. The switch (not shown) is the type used on a flashlight of standard type being a simple push button switch, which is also waterproof. The strobe light section has a strobe light 28, a clip 30, a magnet 32, and means of attachment 34. Clip 30 and magnet 32 are used to attach the strobe light to a proximate object to allow it to be used hands free.

Figure 11:
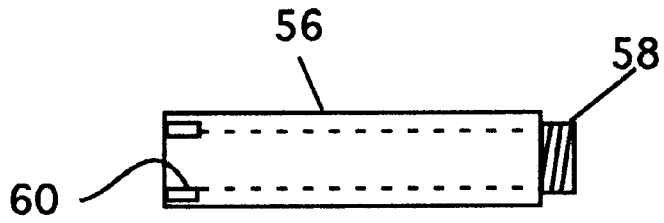
FIG. 11 is a front view of a handle section.
Figure 12:
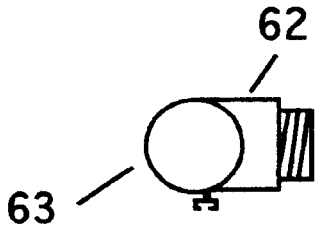
FIG. 12 is a front view of the handle section.

FIG. 11 shows a pistol grip type handle section 56 that is approximately 5 to 6 inches long and it is used as part of a walking stick and also with the stretcher. Also shown are means for attachments 58 and 60 on both ends. FIG. 12 shows another attachment means 62 and clamp 63 for attaching the handles onto the shaft of the present invention.

Figure 13:
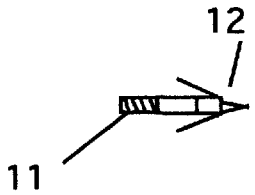
FIG. 13 is a side view of one spear tip.
Figure 14:
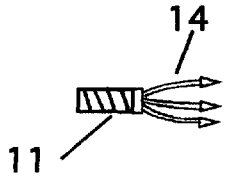
FIG. 14 is a side view of a second spear tip.
Figure 15:
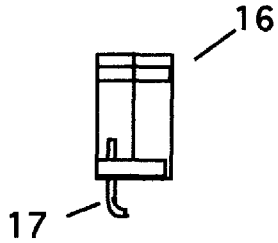
FIG. 15 is a side view of a safety member.
Figure 16:
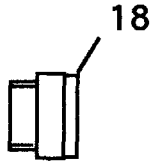
FIG. 16 is a side view of a walking stick tip.
Figure 17:
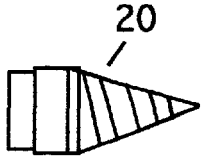
FIG. 17 is a side view of a second walking stick tip.

FIGS. 13 and 14, show alternative designs for the spear tips 12 and 14 having a female threaded aperture 11, which is threaded onto the male threaded member 13 of the spear driver section 19 as shown in FIG. 2, to be used on the spear driver section. FIG. 13 shows a tip 12 with a single point with two barbs. FIG. 14 shows a tip 14 with three points having one barb on each tip. In addition, FIG. 15 shows a member 16 that contains a safety pin 17 to prevent accidental firing as discussed above. FIG. 16 shows member 18 and FIG. 17 shows member 20, which were also discussed above.

Figure 18:
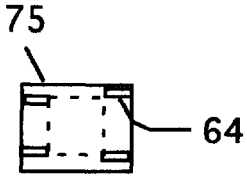
FIG. 18 is a side view of a female adapter.
Figure 19:
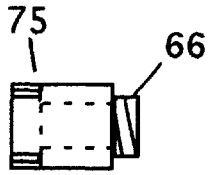
FIG. 19 is a side view of a male adapter.

FIG. 18 shows a side view of the female adapter 75, described above. This adapter has a set of internal threads 64 that mate with the appropriate fixtures, as necessary. FIG. 19 shows the male adapter 76, which has a set of external threads 66 to mate with the appropriate fixtures as needed.

All of the embodiments have a section (72, 74) used for holding survival items such as a fires starter, a first aid kit, a finger saw, and fishing gear.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A survival tool for use as a spear comprising:

a) an upper section having an upper end, a lower end, said upper section being a hallow member disposed to form a compartment in said upper section adapted for storing items;

b) a lower section, having an upper end, a lower end, said lower section being a hollow member disposed to form a compartment in said lower section adapted for storing items;

c) a plurality of intermediate spacer sections, each of said plurality of intermediate spacer sections having an upper end, and a lower end, whereby the upper end of one of said plurality of intermediate sections being removably connectable to the lower end of the upper section and whereby the lower end of one of said plurality of intermediate sections being removably connectable to the upper end of the lower section, and further whereby the remaining intermediate spacer sections of said plurality of intermediate spacer sections being removably disposed between the intermediate spacer section removably attached to said upper section and the intermediate spacer section removably attached to said lower section;

d) whereby at least one of said plurality of intermediate spacer sections includes a flare section for storing a warning flare therein;

e) a triggered spear casing section, removably attached to the lower end of said lower section;

f) a spear, removably held in said triggered spear casing section, said spear including a spear driver and a removable spearhead; and g) a means for firing said spear from said triggered spear casing section.

2. The survival tool of claim 1, wherein the flare section for storing a warning flare therein holds a flare selected from the group of: a fifteen minute flare, a thirty minute flare, or an aerial flare.

3. The survival tool of claim 1, further comprising: a side handle, removably attached to said triggered spear casing and extending perpendicularly outward therefrom.

4. The survival tool of claim 1 where in one of said plurality of intermediate spacer sections includes a strobe light generating section.

5. The survival tool of claim 1 further comprising a plurality of survival items, being stored in said survival tool.

6. The survival tool of claim 5 wherein the plurality of survival items is selected from the group of: a fires starter, a first aid kit, a finger saw, and fishing gear.

7. A survival tool for use as a crutch comprising:

a) an upper section having an upper end, a lower end, said upper section being a hollow member disposed to form a compartment in said upper section adapted for storing items;

b) a curved handle, removably attached to said upper section said curved handle having an inner curve and further whereby said inner curve of said curved handle is position upward, forming a receiver for a user's arm;

c) a lower section, having an upper end, a lower end, said lower section being a hollow member disposed to form a compartment in said lower section adapted for storing items;

d) a plurality of intermediate spacer sections, each of said plurality of intermediate spacer sections having an upper end, and a lower end, whereby the upper end of one of said plurality of intermediate sections being removably connectable to the lower end of the upper section and whereby the lower end of one of said plurality of intermediate sections being removably connectable to the upper end of the lower section, and further whereby the remaining intermediate spacer sections of said plurality of intermediate spacer sections being removably disposed between the intermediate spacer section removably attached to said upper section and the intermediate spacer section removably attached to said lower section;

e) whereby at least one of said plurality of intermediate spacer sections includes a flare section for storing a warning flare therein;

f) a side handle, removably attached to one of said plurality of intermediate spacer portions, and extending perpendicularly outward therefrom; and g) a tip, removably attached to the lower end of said lower section.

8. The survival tool of claim 7 wherein the flare section for storing a warning flare therein holds a flare selected from the group of: a fifteen minute flare, a thirty minute flare, or an aerial flare.

9. The survival tool of claim 7 wherein one of said plurality of intermediate spacer sections is a strobe light generating section.

10. The survival tool of claim 7 further comprising a plurality of survival items, being stored in said survival tool.

11. The survival tool of claim 10 wherein the plurality of survival items is selected from the group of: a fires starter, a first aid kit, a finger saw, and fishing gear.

12. A survival tool for use as a walking stick comprising:

a) an upper section having an upper end, a lower end, said upper section being a hollow member disposed to form a compartment in said upper section adapted for storing items;

b) a curved handle, removably attached to said upper section;

c) a lower section, having an upper end, a lower end, said lower section being a hollow member disposed to form a compartment in said lower section adapted for storing items;

d) a plurality of intermediate spacer sections, each of said plurality of intermediate spacer sections having an upper end, and a lower end, whereby the upper end of one of said plurality of intermediate sections being removably connectable to the lower end of the upper section and whereby the lower end of one of said plurality of intermediate sections being removably connectable to the upper end of the lower section, and further whereby the remaining intermediate spacer between the intermediate spacer section removably attached to said upper section and the immediate spacer section removably attached to said lower section;

e) whereby at least one of said plurality of intermediate spacer sections includes a flare section for storing a warning flare therein;

f) a tip, removably attached to the lower end of said lower section;

g) a second walking stick, including:

i) an upper section having an upper end, a lower end, said upper section being a hollow member disposed to form a compartment in said upper section adapted for storing items;

ii) a curved handle, removably attached to said upper section;

iii) a lower section, having an upper end, a lower end, said lower section being a hollow member disposed to form a compartment in said lower section adapted for storing items; and iv) a plurality of intermediate spacer sections, each of said plurality of intermediate spacer sections having an upper end, and a lower end, whereby the upper end of one of said plurality of intermediate sections being removably connectable to the lower end of the upper section and whereby the lower end of one of said plurality of intermediate sections being removably connectable to the upper end of the lower section, and further whereby the remaining intermediate spacer sections of said plurality of intermediate spacer sections being removably disposed between the intermediate spacer section removably attached to said upper section and the intermediate spacer section removably attached to said lower section; and h) a generally rectangular carrying member, being removably attached to said walking stick and said second walking stick and being stretched between them to form a stretcher body.

13. The survival tool of claim 12 wherein the generally rectangular carrying member is made of a flexible material.

14. The stretcher of claim 12 further comprising: a pair of support legs, one of said pair of support legs being attached to said lower section on said first walking stick and extending perpendicularly downward therefrom; and a second of said pair of support legs being attached to said lower section on said second walking stick and extending perpendicularly downward therefrom.

* * * * *